US006543429B2

(12) United States Patent
Osakabe et al.

(10) Patent No.: US 6,543,429 B2
(45) Date of Patent: Apr. 8, 2003

(54) AIR INDUCTION SYSTEM FOR ENGINE

(75) Inventors: Takayuki Osakabe, Shizuoka (JP); Masaru Suzuki, Shizuoka (JP); Hitoshi Watanabe, Shizuoka (JP)

(73) Assignee: Sanshin Kogyo Kabushiki Kaisha, Hamamatsu (JP)

( * ) Notice: Subject to any disclaimer, the term of this patent is extended or adjusted under 35 U.S.C. 154(b) by 0 days.

(21) Appl. No.: 09/906,570

(22) Filed: Jul. 16, 2001

(65) Prior Publication Data

US 2002/0092511 A1 Jul. 18, 2002

(30) Foreign Application Priority Data

Jul. 14, 2000 (JP) ..... 2000-215162

(51) Int. Cl.[7] ..... F02B 23/00
(52) U.S. Cl. ..... 123/585
(58) Field of Search ..... 123/585, 198 E, 123/184.35, 519, 195 P

(56) References Cited

U.S. PATENT DOCUMENTS

| | | | | |
|---|---|---|---|---|
| 4,898,144 A | * | 2/1990 | Kobayashi et al. | 123/184.43 |
| 4,924,834 A | | 5/1990 | Bonfiglioli et al. | |
| 5,000,130 A | * | 3/1991 | Yamada | 123/184.43 |
| 5,146,888 A | | 9/1992 | Sawamoto | |
| 5,370,098 A | * | 12/1994 | Iida | 123/188.7 |
| 5,516,990 A | * | 5/1996 | Anselm et al. | 181/229 |
| 5,649,512 A | | 7/1997 | Flangery, Jr. et al. | |
| 5,769,060 A | | 6/1998 | Matsumoto | |
| 5,873,332 A | | 2/1999 | Taue et al. | |
| 5,873,347 A | | 2/1999 | Kato et al. | |
| 5,915,363 A | | 6/1999 | Iwata et al. | |
| 5,924,409 A | | 7/1999 | Kato | |
| 5,975,032 A | | 11/1999 | Iwata | |
| 6,015,319 A | | 1/2000 | Tanaka | |
| 6,041,754 A | | 3/2000 | Mori et al. | |
| 6,125,820 A | | 10/2000 | Hiraoka | |

FOREIGN PATENT DOCUMENTS

| | | |
|---|---|---|
| GB | 2 321 085 | 7/1998 |
| JP | 61-93228 | 5/1986 |
| JP | 3-121266 | 5/1991 |
| JP | 2000-130262 | 5/2000 |

OTHER PUBLICATIONS

Co–pending patent application: Ser. No. 09/878,323, filed Jun. 11, 2001, entitled Four–Cycle Engine For Marine Drive, in the name of Isao Kanno, and assigned to Sanshin Kogyo Kabushiki Kaisha.

(List continued on next page.)

*Primary Examiner*—John Kwon
*Assistant Examiner*—Hyder Ali
(74) *Attorney, Agent, or Firm*—Knobbe, Martens, Olson & Bear, LLP

(57) ABSTRACT

An engine includes an engine body and an air induction system. The engine body includes a cylinder block defining a cylinder bore in which a piston reciprocates. A cylinder head member closes an end of the cylinder bore to define a combustion chamber together with the cylinder bore and the piston. The air induction system is arranged to introduce air into the combustion chamber. The induction system includes a first intake conduit through which the air flows to the combustion chamber. A first plenum chamber unit is disposed upstream of the first intake conduit. A control mechanism is arranged to control an amount of the air flowing through the first intake conduit. The induction system also includes a second intake conduit through which the air flows to the combustion chamber. A second plenum chamber unit is disposed upstream of the second intake conduit. The second intake conduit is coupled with the first intake conduit downstream of the control mechanism.

51 Claims, 9 Drawing Sheets

OTHER PUBLICATIONS

Co–pending patent application: Ser. No. 09/742,777, filed Dec. 20, 2000, entitled Component Mounting Arrangement For Engine, in the name of Hitoshi Watanabe, Akihiro Onoue, and assigned to Sanshin Kogyo Kabushiki Kaisha.
Co–pending patent application: Ser. No. 09/694,080, filed Oct. 19, 2000, entitled Electrical System For Marine Outboard Drive, in the name of Yasuo Suganuma, and assigned to Sanshin Kogyo Kabushiki Kaisha.
Co–pending patent application: Ser. No. 09/626,868, filed Jul. 27, 2000, entitled Engine Control System, in the name of Isao Kanno, and assigned to Sanshin Kogyo Kabushiki Kaisha.
Co–pending patent application: Ser. No. 09/494,395, filed Jan. 31, 2000, entitled Engine Idle Control System, in the name of Isao Kanno, Yoshikazu Nakayasu and assigned to Sanshin Kogyo Kabushiki Kaisha.
Co–pending patent application: Ser. No. 09/497,570, filed Feb. 3, 2000, entitled Fuel Injection For Engine, in the name of Isao Kanno, and assigned to Sanshin Kogyo Kabushiki Kaisha.
Co–pending patent application: Ser. No. 09/422,305, filed Oct. 21, 1999, entitled Idle Speed Control For Engines, in the name of yoshikazu Nakayasu, and assigned to Sanshin Kogyo Kabushiki Kaisha.

* cited by examiner

AIR INDUCTION SYSTEM FOR ENGINE

PRIORITY INFORMATION

This application is based on and claims priority to Japanese Patent Application No. 2000-215162, filed Jul. 14, 2001, the entire contents of which is hereby expressly incorporated by reference.

BACKGROUND OF THE INVENTION

1. Field of the Invention

The present invention relates generally to an air induction system for an engine, and more particularly to an improved induction system for an engine that has an auxiliary air intake device.

2. Description of Related Art

An internal combustion engine typically comprises an air induction system with which air is introduced into a combustion chamber of the engine. Typically, the induction system includes an air intake conduit, a plenum chamber unit disposed upstream of the air intake conduit and a throttle valve. The plenum chamber unit is used to reduce pulsation in the airflow to the combustion chamber and/or to reduces noise in the intake system. The throttle valve measures an amount of the air (i.e., controls the airflow rate) and is operable by the operator through an appropriate throttle linkage. The induction system thus can supply a desired amount of air to the combustion chamber in response to a throttle opening degree corresponding to operator demand.

In most engine technologies, the engine maintains a certain preset engine speed although substantially no engine load is being applied; this is an idle condition. Typically, the throttle valve is held in an almost closed position under the idle condition. In some engine configurations, an auxiliary intake conduit is provided to bypass the throttle valve so that a certain preset amount of air can be supplied to the combustion chamber even through the throttle valve is substantially closed under the idle condition. For example, U.S. Pat. No. 6,015,319 discloses an improved arrangement of an air induction system that includes such a bypass intake conduit.

Although the idle air is delivered to the combustion chamber through the auxiliary intake conduit, the throttle valve desirably is slightly opened to allow a light air flow through the primary intake conduit to prevent sticking of the throttle valve when higher engine speed operation is desired. Under these circumstances, a problem can arise; the idle speed can exceed a desired objective idle speed or the engine can stall. These two conditions result because the amount of idle air that the engine requires is extremely small because only a low rate of airflow is necessary to maintain a desired objective idle speed. The low rate of airflow is quite sensitive and is likely to be out of tune by external forces such as a negative pressure exerted upon the air. The negative pressure can be produced by the light air flow through the primary intake conduit.

A need therefore exists for an improved air induction system for an engine that can provide an accurate amount of idle air to a combustion chamber thereof.

In some configurations, outboard motors can employ an air induction system that includes an auxiliary intake conduit. Outboard motors also often have a certain decibel of noise associated with their operation. Because the outboard motor typically is used adjacent to the operator (i.e., mounted to the transom of the watercraft), intake noise preferably is isolated from the operator as much as possible.

Another need thus exists for an improved engine for an outboard motor that can isolate the intake noise from the operator as much as possible when the outboard motor is in use.

SUMMARY OF THE INVENTION

In accordance with one aspect of the present invention, an internal combustion engine comprises an engine body and an air induction system. The engine body comprises a cylinder block defining a cylinder bore in which a piston reciprocates. A cylinder head member closes an end of the cylinder bore to define a combustion chamber together with the cylinder bore and the piston. The air induction system is arranged to introduce air into the combustion chamber. The induction system includes a first intake conduit through which the air flows to the combustion chamber. A first plenum chamber unit is disposed upstream the first intake conduit. A control mechanism is arranged to control an amount of the air flowing through the first intake conduit. The induction system includes a second intake conduit through which the air flows to the combustion chamber. A second plenum chamber unit is disposed upstream the second intake conduit. The second intake conduit is coupled with the first intake conduit downstream the control mechanism.

In accordance with another aspect of the present invention, an internal combustion engine comprises an engine body. A moveable member is moveable relative to the engine body. The engine body and the moveable member together define a combustion chamber. An air induction system is arranged to introduce air into the combustion chamber. The induction system includes a primary intake conduit through which the air flows to the combustion chamber. A first voluminous unit is disposed upstream the primary intake conduit. A throttle valve is arranged to control an amount of the air flowing through the primary intake conduit. The throttle valve generally allows the majority of the air to flow through the primary intake conduit at engine speed above idle. The induction system includes an auxiliary intake conduit through which at least the air at idle speed flows to the combustion chamber. A second voluminous unit disposed upstream the auxiliary intake conduit. The auxiliary intake conduit is coupled with the primary intake conduit downstream the throttle valve.

In accordance with a further aspect of the present invention, an internal combustion engine comprises an engine body. A moveable member is moveable relative to the engine body. The engine body and the moveable member together define a combustion chamber. An air induction system is arranged to introduce air into the combustion chamber. The induction system includes an intake conduit through which the air flows. A first member is provided. A second member is provided. The second member, together with the first member, defines a plenum chamber disposed upstream the intake conduit. Both the first and second members are mounted on the engine body. The first and second members are coupled with one another to form a gap therebetween through which the air enters the plenum chamber.

In accordance with a still further aspect of the present invention, an outboard motor comprises a drive unit. A bracket assembly is adapted to be mounted on an associated watercraft to support the drive unit. The drive unit includes an internal combustion engine. The engine comprises an engine body. A moveable member is moveable relative to the engine body. The engine body and the moveable member together define a combustion chamber. An air induction system is arranged to introduce air into the combustion chamber. The induction system includes a first intake conduit through which the air flows to the combustion chamber. A first plenum chamber unit is disposed upstream the first intake conduit. A control mechanism is configured to control an amount of the air flowing through the first intake conduit. The induction system includes a second intake conduit through which the air flows to the combustion chamber. A second plenum chamber unit is disposed upstream the second intake conduit. The second intake conduit is coupled with the first intake conduit downstream the control mechanism. The second plenum chamber unit is disposed opposite to the bracket assembly relative to the engine body.

BRIEF DESCRIPTION OF THE DRAWINGS

These and other features, aspects and advantages of the present invention will now be described with reference to the drawings of preferred embodiments, which embodiments are intended to illustrate and not to limit the present invention. The drawings comprise nine figures.

DETAILED DESCRIPTION OF THE PREFERRED EMBODIMENTS OF THE INVENTION

Figure 1:
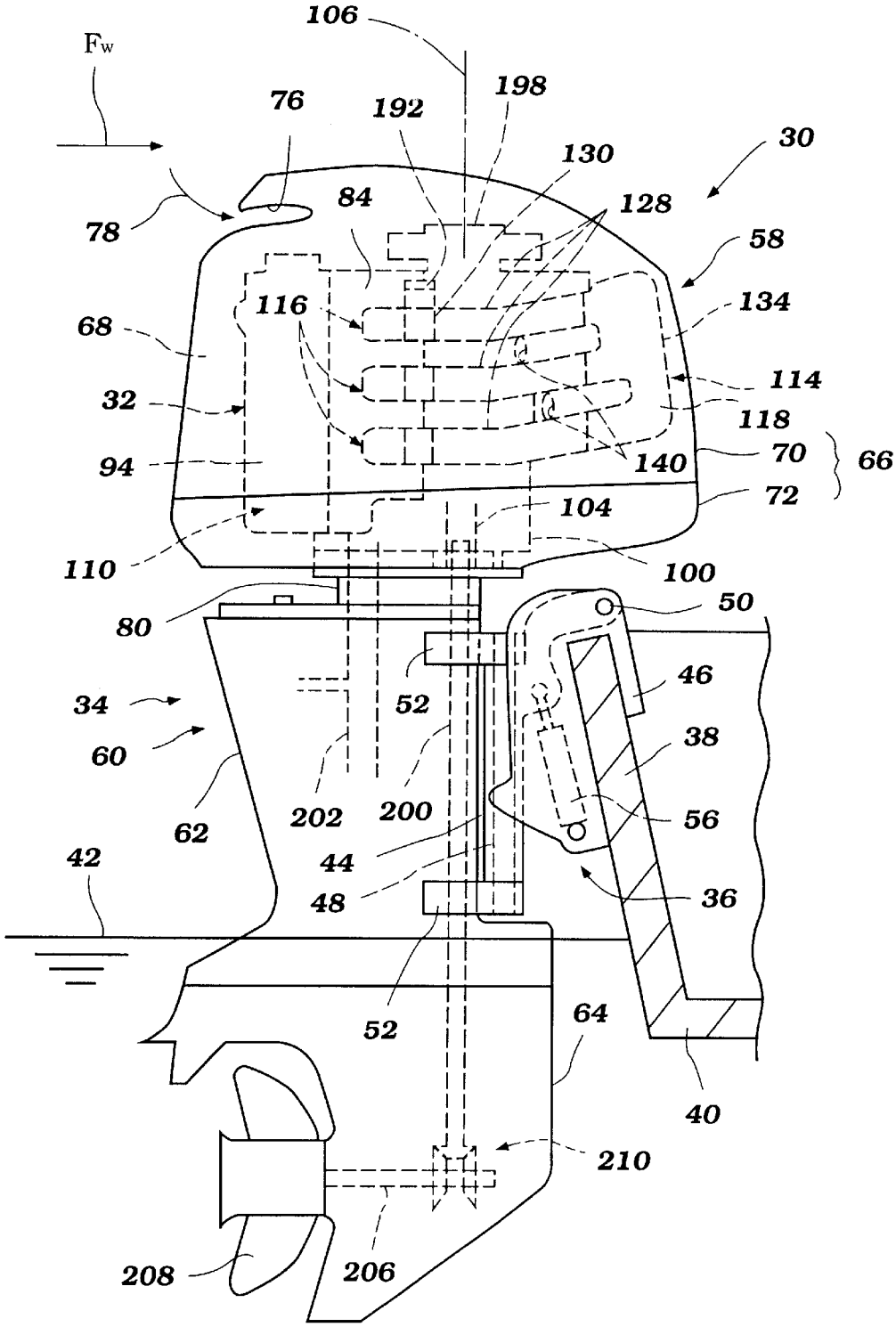
FIG. 1 is a side elevation view of an outboard motor configured in accordance with a preferred embodiment of the present invention. An associated watercraft is partially shown in section.

With reference to FIGS. 1–4, an overall construction of an outboard motor 30 that employs an internal combustion engine 32 configured in accordance with certain features, aspects and advantages of the present invention will be described. The engine 32 has particular utility in the context of a marine drive, such as the outboard motor 30 for instance, and thus is described in the context of an outboard motor. The engine 32, however, can be used with other types of marine drives (i.e., inboard motors, inboard/outboard motors, etc.) and also certain land vehicles, which includes lawnmowers, motorcycles, go carts, all terrain vehicles and the like. Furthermore, the engine 32 can be used as a stationary engine for some applications that will become apparent to those of ordinary skill in the art.

In the illustrated arrangement, the outboard motor 30 generally comprises a drive unit 34 and a bracket assembly 36. The bracket assembly 36 supports the drive unit 34 on a transom 38 of an associated watercraft 40 and places a marine propulsion device in a submerged position with the watercraft 40 resting relative to a surface 42 of a body of water. The bracket assembly 36 preferably comprises a swivel bracket 44, a clamping bracket 46, a steering shaft 48 and a pivot pin 50.

The steering shaft 48 typically extends through the swivel bracket 44 and is affixed to the drive unit 34 by top and bottom mount assemblies 52. The steering shaft 48 is pivotally journaled for steering movement about a generally vertically extending steering axis defined within the swivel bracket 44. The clamping bracket 46 comprises a pair of bracket arms that preferably are laterally spaced apart from each other and that are attached to the watercraft transom 38.

The pivot pin 50 completes a hinge coupling between the swivel bracket 44 and the clamping bracket 46. The pivot pin 50 preferably extends through the bracket arms so that the clamping bracket 46 supports the swivel bracket 44 for pivotal movement about a generally horizontally extending tilt axis defined by the pivot pin 50. The drive unit 34 thus can be tilted or trimmed about the pivot pin 50.

As used through this description, the terms "forward," "forwardly" and "front" mean at or to the side where the bracket assembly 36 is located, unless indicated otherwise or otherwise readily apparent from the context use. The arrows Fw of FIGS. 1, 2, 5, 6 and 8 indicate the forward direction. The terms "rear," "reverse," "backwardly" and "rearwardly" mean at or to the opposite side of the front side.

A hydraulic tilt and trim adjustment system 56 preferably is provided between the swivel bracket 44 and the clamping bracket 46 for tilt movement (raising or lowering) of the swivel bracket 44 and the drive unit 34 relative to the clamping bracket 46. Otherwise, the outboard motor 30 can have a manually operated system for tilting the drive unit 34. Typically, the term "tilt movement", when used in a broad sense, comprises both a tilt movement and a trim adjustment movement.

The illustrated drive unit 34 comprises a power head 58 and a housing unit 60, which includes a driveshaft housing 62 and a lower unit 64. The power head 58 is disposed atop the housing unit 60 and includes an internal combustion engine 32 that is positioned within a protective cowling assembly 66, which preferably is made of plastic. In most arrangements, the protective cowling assembly 66 defines a generally closed cavity 68 in which the engine 32 is disposed. The engine, thus, is generally protected from environmental elements within the enclosure defined by the cowling assembly 66.

The protective cowling assembly 66 preferably comprises a top cowling member 70 and a bottom cowling member 72. The top cowling member 70 preferably is detachably affixed to the bottom cowling member 72 by a coupling mechanism so that a user, operator, mechanic or repairperson can access the engine 32 for maintenance or for other purposes. In some arrangements, the top cowling member 70 is hingedly attached to the bottom member such that the top cowling member 70 can be pivoted away from the bottom cowling member for access to the engine. Preferably, such a pivoting allows the top cowling member to be pivoted about the rear end of the outboard motor, which facilitates access to the engine from within the associated watercraft 40.

The top cowling member 64 preferably has a rear intake opening 76 defined through an upper rear portion. A rear intake member with one or more air ducts is unitarily formed with or is affixed to the top cowling member 70. The rear intake member, together with the upper rear portion of the top cowling member 70, generally defines a rear air intake space. Ambient air is drawn into the closed cavity 68 via the rear intake opening 76 and the air ducts of the rear intake member as indicated by the arrow 78 of FIG. 1. Typically, the top cowling member 70 tapers in girth toward its top surface, which is in the general proximity of the air intake opening 76. The taper helps to reduce the lateral dimension of the outboard motor, which helps to reduce the air drag on the watercraft during movement.

The bottom cowling member 72 preferably has an opening through which an upper portion of an exhaust guide member 80 extends. The exhaust guide member 80 preferably is made of aluminum alloy and is affixed atop the driveshaft housing 62. The bottom cowling member 72 and the exhaust guide member 80 together generally form a tray. The engine 32 is placed onto this tray and can be affixed to the exhaust guide member 80. The exhaust guide member 80 also defines an exhaust discharge passage through which burnt charges (e.g., exhaust gases) from the engine 32 pass.

Figure 2:
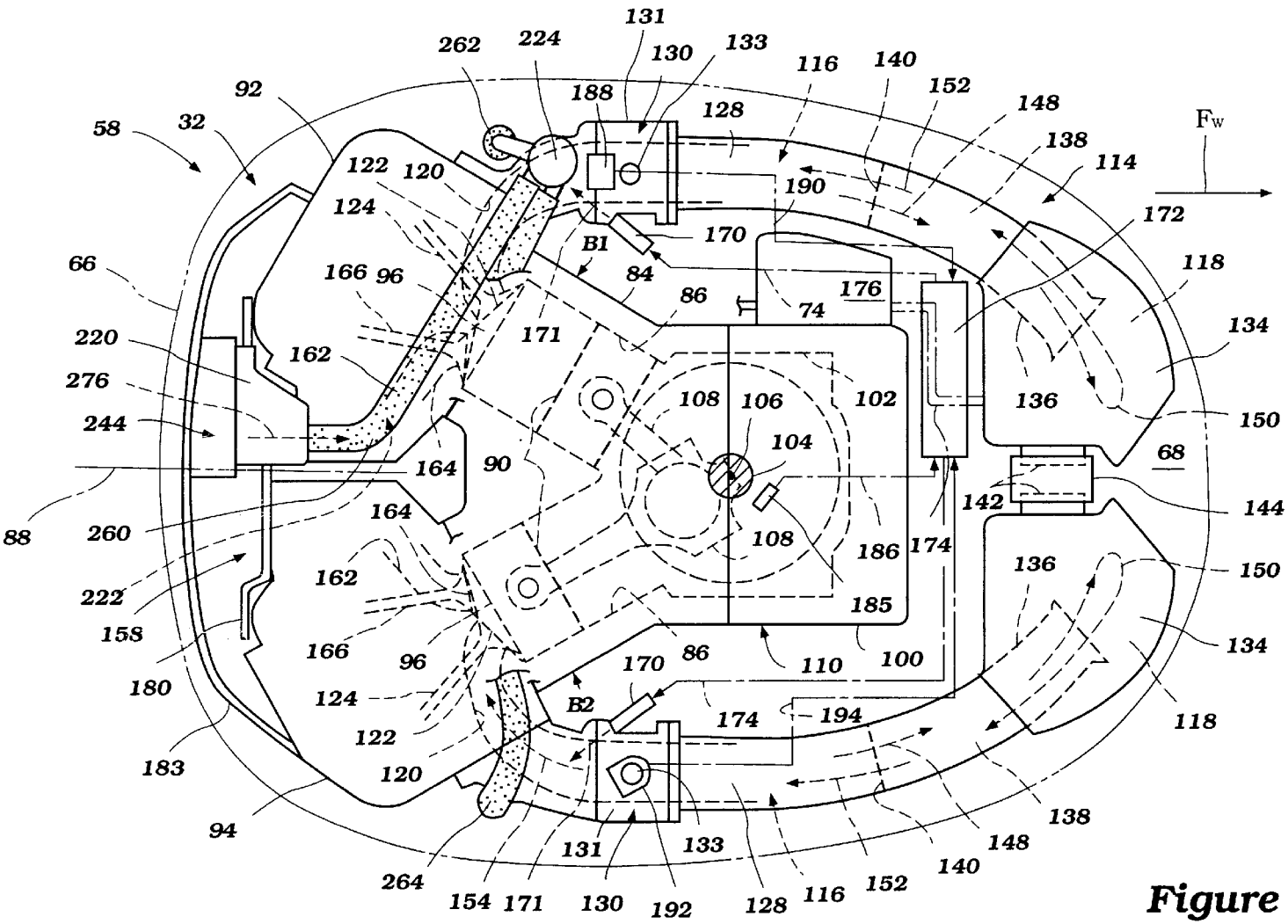
FIG. 2 is a top plan view of an engine of the outboard motor. A protective cowling is shown in phantom line.

The engine 32 in the illustrated embodiment preferably operates on a four-cycle combustion principle. With reference now to FIG. 2, the presently preferred engine 32 has a cylinder block 84 configured as a V shape. The cylinder block 84 thus defines two cylinder banks B1, B2 which extend side by side with each other. In the illustrated arrangement, the cylinder bank B1 is disposed on the port side, while the cylinder bank B2 is disposed on the starboard side. In the illustrated arrangement, each cylinder bank B1, B2 has three cylinder bores 86 such that the cylinder block 84 has six cylinder bores 86 in total. The cylinder bores 86 of each bank B1, B2 extend generally horizontally and are generally vertically spaced from one another. As used in this description, the term "horizontally" means that the subject portions, members or components extend generally in parallel to the water surface 42 (i.e., generally normal to the direction of gravity) when the associated watercraft 40 is substantially stationary with respect to the water surface 42 and when the drive unit 34 is not tilted (i.e., is placed in the position shown in FIG. 1). The term "vertically" in turn means that portions, members or components extend generally normal to those that extend horizontally.

The illustrated engine 32 generally is symmetrical about a longitudinal center plane 88 that extends generally vertically and fore to aft of the outboard motor 30. This type of engine, however, merely exemplifies one type of engine on which various aspects and features of the present invention can be suitably used. Engines having other numbers of cylinders, having other cylinder arrangements (in-line, opposing, etc.), and operating on other combustion principles (e.g., crankcase compression two-stroke or rotary) also can employ various features, aspects and advantages of the present invention. In addition, the engine can be formed with separate cylinder bodies rather than a number of cylinder bores formed in a cylinder block. Regardless of the particular construction, the engine preferably comprises an engine body that includes at least one cylinder bore.

A moveable member, such as a reciprocating piston 90, moves relative to the cylinder block 84 in a suitable manner. In the illustrated arrangement, a piston 90 reciprocates within each cylinder bore 86.

Because the cylinder block 84 is split into the two cylinder banks B1, B2, each cylinder bank B1, B2 extends outward at an angle to an independent first end in the illustrated arrangement. While a cylinder head assembly 92 is affixed to the first end of the cylinder bank B1 to close that end of the cylinder bores 86 on this bank B1, another cylinder head assembly 94 is affixed to the first end of the cylinder bank B2 to close that end of the cylinder bores 86 on this bank B2. The cylinder head assemblies 92, 94, together with the associated pistons 90 and cylinder bores 86, preferably define six combustion chambers 96. Of course, the number of combustion chambers can vary, as indicated above.

A crankcase member 100 closes the other end of the cylinder bores 86 and, together with the cylinder block 84, defines a crankcase chamber 102. A crankshaft 104 extends generally vertically through the crankcase chamber 102 and can be journaled for rotation about a rotational axis 106 by several bearing blocks. The rotational axis 106 of the crankshaft 104 preferably is on the longitudinal center plane 88. Connecting rods 108 couple the crankshaft 104 with the respective pistons 90 in any suitable manner. Thus, the reciprocal movement of the pistons 90 rotates the crankshaft 104.

Preferably, the crankcase member 100 is located at the forwardmost position of the engine 32, with the cylinder block 84 and the cylinder head assemblies 92, 94 being disposed rearward from the crankcase member 100, one after another. Generally, the cylinder block 84 (or individual cylinder bodies), the cylinder head assemblies 92, 94 and the crankcase member 100 together define an engine body 110. Preferably, at least these major engine portions 84, 92, 94, 100 are made of aluminum alloy. The aluminum alloy advantageously increases strength over cast iron while decreasing the weight of the engine body 110.

The engine 32 also comprises an air induction system 114. The air induction system 114 draws air from within the cavity 68 to the combustion chambers 96. The air induction system 114 preferably comprises six intake passages 116 and a pair of plenum chambers 118. In the illustrated arrangement, each cylinder bank B1, B2 is allotted with three intake passages 116 and one plenum chamber 118.

The most-downstream portions of the intake passages 116 are defined within the cylinder head assemblies 92, 94 as inner intake passages 120. The inner intake passages 120 communicate with the combustion chambers 96 through intake ports 122, which are formed at inner surfaces of the cylinder head assemblies 92, 94. Typically, each of the combustion chambers 96 has one or more intake ports 122. Intake valves 124 are slidably disposed at each cylinder head assembly 92, 94 to move between an open position and a closed position. As such, the valves 124 act to open and close the ports 122 to control the flow of air into the combustion chamber 96. Biasing members, such as springs, are used to urge the intake valves 124 toward the respective closed positions by acting between a mounting boss formed on each cylinder head assembly 92, 94 and a corresponding retainer that is affixed to each of the valves 124. When each intake valve 124 is in the open position, the inner intake passage 120 that is associated with the intake port 122 communicates with the associated combustion chamber 96.

Outer portions of the intake passages 116, which are disposed outside of the cylinder head assemblies 92, 94, preferably are defined with intake conduits 128. Each intake conduit 128 includes a control mechanism or throttle valve assembly 130. In the illustrated arrangement, the intake conduit 128 is formed with two pieces with the throttle valve assembly 130 being positioned therebetween. While the intake conduits 128 allotted to the cylinder bank B1 extend forwardly along a side surface of the engine body 110 on the port side from the cylinder head assembly 92 to the front of the crankcase member 100, the intake conduits 128 allotted to the cylinder bank B2 extend forwardly along a side surface of the engine body 110 on the starboard side from the cylinder head assembly 94 to the front of the crankcase member 100.

Each throttle valve assembly 130 preferably includes a throttle body 131 and a throttle valve 132 disposed within the throttle body 131. The intake conduits 128 and the throttle bodies 131 preferably are made of aluminum alloy. In some arrangements, these components can be made of plastic. Preferably, the throttle valves 132 are butterfly valves that have valve shafts 133 journaled for pivotal movement about a generally vertical axis. In some arrangements, the valve shafts 133 are linked together and are connected to a control linkage. The control linkage would be connected to an operational member, such as a throttle lever, that is provided on the watercraft or otherwise proximate the operator of the watercraft. The operator can control the opening degree of the throttle valves 132 in accordance with operator demand through the control linkage. That is, the throttle valve assemblies 130 can measure or regulate amounts of air that flow through the intake passages 116 to the combustion chambers 96 in response to the operation of the operational member by the operator. Normally, the greater the opening degree, the higher the rate of airflow and the higher the engine speed.

Figure 3:
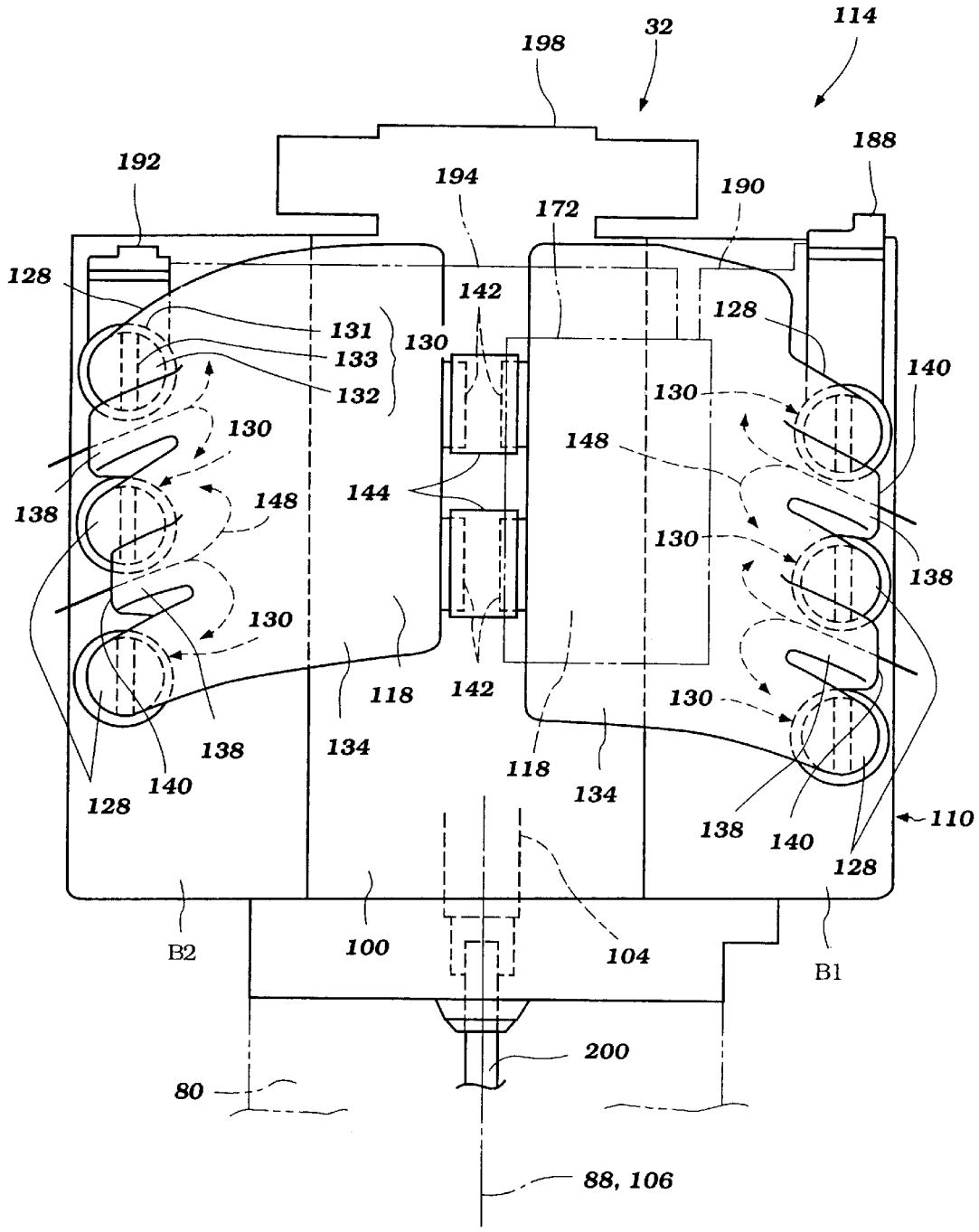
FIG. 3 is a front elevation view of the engine, which is disposed above an exhaust guide member. The exhaust guide member is partially shown in phantom line.

The respective plenum chambers 118 preferably are defined with plenum chamber units or voluminous units 134 which are disposed side by side in front of the crankcase member 100. Preferably, the plenum chambers 134 are arranged substantially symmetrically relative to the longitudinal center plane 88. In the illustrated arrangement, each forward end portion 136 of the intake conduits 128 is housed within each plenum chamber unit 134. As illustrated in FIG. 3, each plenum chamber unit 134 preferably has two air inlets 138, which extend generally rearwardly between the respective intake conduits 128. That is, two of the intake conduits 128 are formed with one inlet 138 extending therebetween. The respective air inlets 138 define inlet openings 140 through which air is drawn into the plenum chambers 118. The plenum chamber units 134 also have other two openings 142 which are defined on another side and which are spaced apart vertically from one another. The openings 142 of one plenum chamber unit 134 preferably are formed opposite to the openings 142 of the other plenum chamber unit 134 and are coupled with each other by balancer pipes 144. Advantageously, this construction provides a manner of roughly equalizing the pressures within each chamber unit 134. The plenum chambers 118 coordinate air delivered to each intake passage 116 and also act as silencers to reduce intake noise. In other words, the chambers 118 act to reduce the pulsation energy within the intake system and to smooth the airflow being introduced to the engine. The air in both of the chambers 118 also is coordinated with one another through the balancer pipes 144. The plenum chamber units 134 and the balancer pipes 144 preferably are made of plastic, although they can of course be made of metal material such as, for example, aluminum alloy.

The air within the closed cavity 68 is drawn into the plenum chambers 118 through the inlet openings 140 as indicated by the arrows 148 of FIGS. 2 and 3. The air expands within the plenum chambers 118 to reduce pulsations and then enters the outer intake passages 116 through the end portions 136, as indicated by the arrows 150 of FIG. 2. The air passes through the outer intake passages 116 and flows into the inner intake passages 120 as indicated by the arrows 152, 154 of FIG. 2. As described, the level of airflow is measured by the throttle valve assemblies 130 before the air enters the inner intake passages 120.

In the illustrated embodiment, the throttle valves 132 are substantially closed to bring the engine 32 to idle speed and to maintain this speed. Preferably, the valves 132 are not fully closed such that the likelihood of throttle valve sticking can be reduced. As used throughout the description, the term "idle speed" generally means a low engine speed that is achieved when the throttle valves 132 are closed but also includes a state in which the valves 132 are slightly opened to allow a small level of airflow through the intake passages 116. Also, the outboard motor 30 is often used for trolling, which is a very low speed, generally forward movement of the watercraft. Thus, when trolling, a shift mechanism, which will be described later, is in a forward position and the engine 32 operates in the idle speed.

The illustrated air induction system 114 preferably includes an idle or auxiliary air delivery mechanism 158 that can deliver idle air to the combustion chambers 96 when the throttle valves 132 are substantially closed. The downstream portion of the mechanism 158 is connected to the air intake passages 116 downstream of the throttle valve assemblies 130. Because the illustrated idle air delivery mechanism 158 acts as an idle speed control (ISC) mechanism, the mechanism will be called an as ISC mechanism for short within this description unless otherwise indicated. The ISC mechanism 158 will be described in greater detail later, primarily with reference to FIGS. 4 and 5.

The engine 32 also includes an exhaust system that routes burnt charges, i.e., exhaust gases, to a location outside of the outboard motor 30. Each cylinder head assembly 92, 94 defines a set of inner exhaust passages 162 that communicate with the combustion chambers 96 through one or more exhaust ports 164, which may be defined at the inner surfaces of the respective cylinder head assemblies 92, 94. The exhaust ports 164 can be selectively opened and closed by exhaust valves 166. The construction of each exhaust valve and the arrangement of the exhaust valves are substantially the same as the intake valve and the arrangement thereof, respectively. Thus, further description of these components is deemed unnecessary.

Exhaust manifolds preferably are defined generally vertically within the cylinder block 84 between the cylinder bores 86 of both the cylinder banks B1, B2. The exhaust manifolds communicate with the combustion chambers 96 through the inner exhaust passages 162 and the exhaust ports 164 to collect exhaust gases therefrom. The exhaust manifolds are coupled with the exhaust discharge passage of the exhaust guide member 80. When the exhaust ports 164 are opened, the combustion chambers 96 communicate with the exhaust discharge passage through the exhaust manifolds.

A valve cam mechanism preferably is provided for actuating the intake and exhaust valves 124, 166 in each cylinder bank B1, B2. Preferably, the valve cam mechanism includes one or more camshafts per cylinder bank, which camshafts extend generally vertically and are journaled for rotation relative to the cylinder head assemblies 92, 94. The camshafts have cam lobes to push valve lifters that are affixed to the respective ends of the intake and exhaust valves 124, 166 in any suitable manner. The cam lobes repeatedly push the valve lifters in a timed manner, which is in proportion to the engine speed. The movement of the lifters generally is timed by rotation of the camshafts to appropriately actuate the intake and exhaust valves 124, 166.

A camshaft drive mechanism (not shown) preferably is provided for driving the valve cam mechanism. Thus, the intake and exhaust camshafts comprise intake and exhaust driven sprockets positioned atop the intake and exhaust camshafts, respectively, while the crankshaft 104 has a drive sprocket positioned atop thereof. A timing chain or belt is wound around the driven sprockets and the drive sprocket. The crankshaft 104 thus drives the respective camshafts through the timing chain in the timed relationship. Because the camshafts must rotate at half of the speed of the rotation of the crankshaft 104 in a four-cycle engine, a diameter of the driven sprockets is twice as large as a diameter of the drive sprocket.

The engine 32 preferably has indirect, port or intake passage fuel injection. The fuel injection system preferably comprises six fuel injectors 170 with one fuel injector allotted for each one of the respective combustion chambers 96. The fuel injectors 170 preferably are mounted on the throttle bodies 131 and a pair of fuel rails connects the respective fuel injectors 170 with each other on each cylinder bank B1, B2. The fuel rails also define portions of the fuel conduits to deliver fuel to the injectors 170.

Each fuel injector 170 preferably has an injection nozzle directed downstream within the associated intake passage 116, which is downstream of the throttle valve assembly 130. The fuel injectors 170 spray fuel into the intake passages 130, as indicated by the arrows 171 of FIG. 2, under control of an electronic control unit (ECU) 172. Control signals of the fuel injectors 170 are transmitted to the fuel injectors 170 from the ECU 172 through control lines 174. The ECU 172 controls both the initiation timing and the duration of the fuel injection cycle of the fuel injectors 170 so that the nozzles spray a proper amount of fuel each combustion cycle.

The ECU 172 preferably is disposed between a forward surface of the crankcase member 100 and the plenum chamber unit 134 on the port side, and preferably is mounted on the forward surface of the crankcase member 100. Air is drawn over the ECU 172 to help cool the ECU during operation of the engine.

Typically, a fuel supply tank disposed on a hull of the associated watercraft 40 contains the fuel. The fuel is delivered to the fuel rails through the fuel conduits and at least one fuel pump, which is arranged along the conduits. The fuel pump pressurizes the fuel to the fuel rails and finally to the fuel injectors 170. A vapor separator 176 preferably is disposed along the conduits to separate vapor from the fuel and can be mounted on the engine body 110 at the side surface on the port side. In the illustrated embodiment, a vapor delivery conduit 174 couples the vapor separator 176 with at least one of the plenum chambers 118. The vapor thus can be delivered to the plenum chamber 118 for delivery to the combustion chambers 96 together with the air for combustion. In other applications, the engine 32 can be provided with a ventilation system arranged to send lubricant vapor to the plenum chambers. In such applications, the fuel vapor also can be sent to the plenum chambers via the ventilation system. The fuel injection system and the vapor separator are disclosed, for example, in U.S. Pat. Nos. 5,873,347, 5,915,363 and 5,924,409, the disclosures of which are hereby incorporated by reference. It should be noted that a direct fuel injection system that sprays fuel directly into the combustion chambers can replace the indirect fuel injection system described above. Moreover, other charge forming devices, such as carburetors, can be used instead of the fuel injection systems.

The engine 32 further comprises an ignition or firing system. Each combustion chamber 96 is provided with a spark plug which preferably is disposed between the intake and exhaust valves 124, 166. Each spark plug has electrodes that are exposed into the associated combustion chamber 96 and that are spaced apart from each other with a small gap. The spark plugs are connected to the ECU 172 through appropriate control lines and an ignition device 177 (see FIG. 4), such as ignition coils 178, are provided such that ignition timing is controlled by the ECU 172. In the illustrated embodiment, three ignition coils 178 are provided with one coil 178 allotted to two of the spark plugs. The ignition coils 178 preferably are disposed in line to be spaced apart vertically with each other and are affixed to a bracket 180 by appropriate fasteners such as bolts 181.

The spark plugs generate a spark between the electrodes to ignite an air/fuel charge in the combustion chamber 96 at selected ignition timing under control of the ECU 172. The bracket 180 preferably is mounted on a rear surface of the cylinder head assemblies 92, 94 and can be detachably affixed thereto by appropriate fasteners such as bolts 182. A cover member 183 also can be detachably affixed to the cylinder head assemblies 92, 94 by appropriate fasteners, such as bolts 184, to extend over the entire bracket 180 including the ignition coils 178. Water thus is effectively inhibited from splashing onto the ignition coils 178. The bracket 180 and the cover member 183 will be described in greater detail later.

For use by the ECU 172, the engine 32 may have various sensors. In the illustrated embodiment, a crankshaft angle position sensor 185 preferably is provided to monitor the crankshaft 104. The angle position sensor 185, when measuring crankshaft angle versus time, outputs a crankshaft rotational speed signal or an engine speed signal that is sent to the ECU 172 through a sensor signal line 186. The sensor 185 preferably comprises a pulsar coil positioned adjacent to the crankshaft 104 and a projection or cut formed on the crankshaft 104. The pulsar coil generates a pulse when the projection or cut passes proximate the pulsar coil. In some arrangements, the number of pulses can be counted. The sensor 185 thus can sense not only a specific crankshaft angle but also a rotational speed of the crankshaft 104, i.e., engine speed. Of course, other types of speed sensors also can be used.

An air intake pressure sensor 188 preferably is positioned atop the uppermost throttle assembly 130 for the intake passage 116 of the cylinder bank B1 on the port side. The intake pressure sensor 188 senses the intake pressure in this passage 116 during engine operation. The sensed signal is sent to the ECU 172 through a sensor signal line 190. This signal can be used for determining engine load. Of course, other suitable placements of the sensor also can be used and other sensors that can determine engine load can be used.

A throttle valve position sensor 192 preferably is provided atop and proximate the valve shaft assembly 133 of the throttle assembly 130 for the intake passage 116 of the cylinder bank B2 on the starboard side. The throttle valve position sensor 192 senses an opening degree or opening position of the throttle valves 132 on this side. A sensed signal is sent to the ECU 172 through a sensor signal line 194. Of course, other sensors and placements also can be used.

While the illustrated arrangement features hard-wired sensors and components, the signals can be sent through emitter and detector pairs, infrared radiation, radio waves or the like. The type of signal and the type of connection can be varied between sensors or the same type can be used with all sensors.

In the illustrated engine 32, the pistons 90 reciprocate between top dead center and bottom dead center. When the crankshaft 104 makes two rotations, the pistons 90 generally move from the top dead center position to the bottom dead center position (the intake stroke), from the bottom dead center position to the top dead center position (the compression stroke), from the top dead center position to the bottom dead center position (the power stroke) and from the bottom dead center position to the top dead center position (the exhaust stroke). During the four strokes of the pistons 90, the camshafts make one rotation and actuate the intake and exhaust valves 124, 166 to open the intake and exhaust ports 122, 164 during the intake stroke and the exhaust stroke, respectively.

Generally, during the intake stroke, air is drawn into the combustion chambers 96 through the air intake passages 116 and fuel is injected into the intake passages 116 by the fuel injectors 170. The air and the fuel thus are mixed to form the air/fuel charge in the combustion chambers 96. Slightly before or during the power stroke, the respective spark plugs ignite the compressed air/fuel charge in the respective combustion chambers 96. The air/fuel charge thus rapidly burns during the power stroke to move the pistons 90. The burnt charge, i.e., exhaust gases, then are discharged from the combustion chambers 96 during the exhaust stroke.

The engine 32 may comprise a cooling system, a lubrication system and other systems, mechanisms or devices other than the systems described above.

A flywheel assembly 198 preferably is positioned above atop the crankshaft 104 and is mounted for rotation with the crankshaft 104. The flywheel assembly 198 comprises a flywheel magneto or AC generator that supplies electric power to various electrical components, such as the fuel injection system, the ignition system and the ECU 172.

With reference again to FIG. 1, the driveshaft housing 62 depends from the power head 58 to support a driveshaft 200 which is coupled with the crankshaft 104 and which extends generally vertically through the driveshaft housing 62. The driveshaft 200 is journaled for rotation and is driven by the crankshaft 104. The driveshaft housing 62 preferably defines an internal section 202 of the exhaust system that leads the majority of exhaust gases to the lower unit 64. The internal section 202 includes an idle discharge portion that is branched off from a main portion of the internal section 202 to discharge idle exhaust gases directly out to the atmosphere through a discharge port that is formed on a rear surface of the driveshaft housing 62 in idle speed of the engine 32. The exhaust internal section 202 is schematically shown in FIG. 1 to include a portion of the exhaust manifolds and the exhaust discharge passage.

The lower unit 64 depends from the driveshaft housing 62 and supports a propulsion shaft 206 that is driven by the driveshaft 200. The propulsion shaft 206 extends generally horizontally through the lower unit 64 and is journaled for rotation. A propulsion device is attached to the propulsion shaft 206. In the illustrated arrangement, the propulsion device is a propeller 208 that is affixed to an outer end of the propulsion shaft 206. The propulsion device, however, can take the form of a dual counter-rotating system, a hydrodynamic jet, or any of a number of other suitable propulsion devices.

A transmission 210 preferably is provided between the driveshaft 200 and the propulsion shaft 206, which lie generally normal to each other (i.e., at a 90° shaft angle) to couple together the two shafts 200, 206 by bevel gears. The outboard motor 30 has a clutch mechanism that allows the transmission 210 to change the rotational direction of the propeller 208 among forward, neutral or reverse.

The lower unit 64 also defines an internal section of the exhaust system that is connected with the internal exhaust section 202 of the driveshaft housing 62. At engine speeds above idle, the exhaust gases generally are discharged to the body of water surrounding the outboard motor 30 through the internal sections and then a discharge section defined within the hub of the propeller 208. Incidentally, the exhaust system can include a catalytic device at any location in the exhaust system to purify the exhaust gases.

Figure 4:
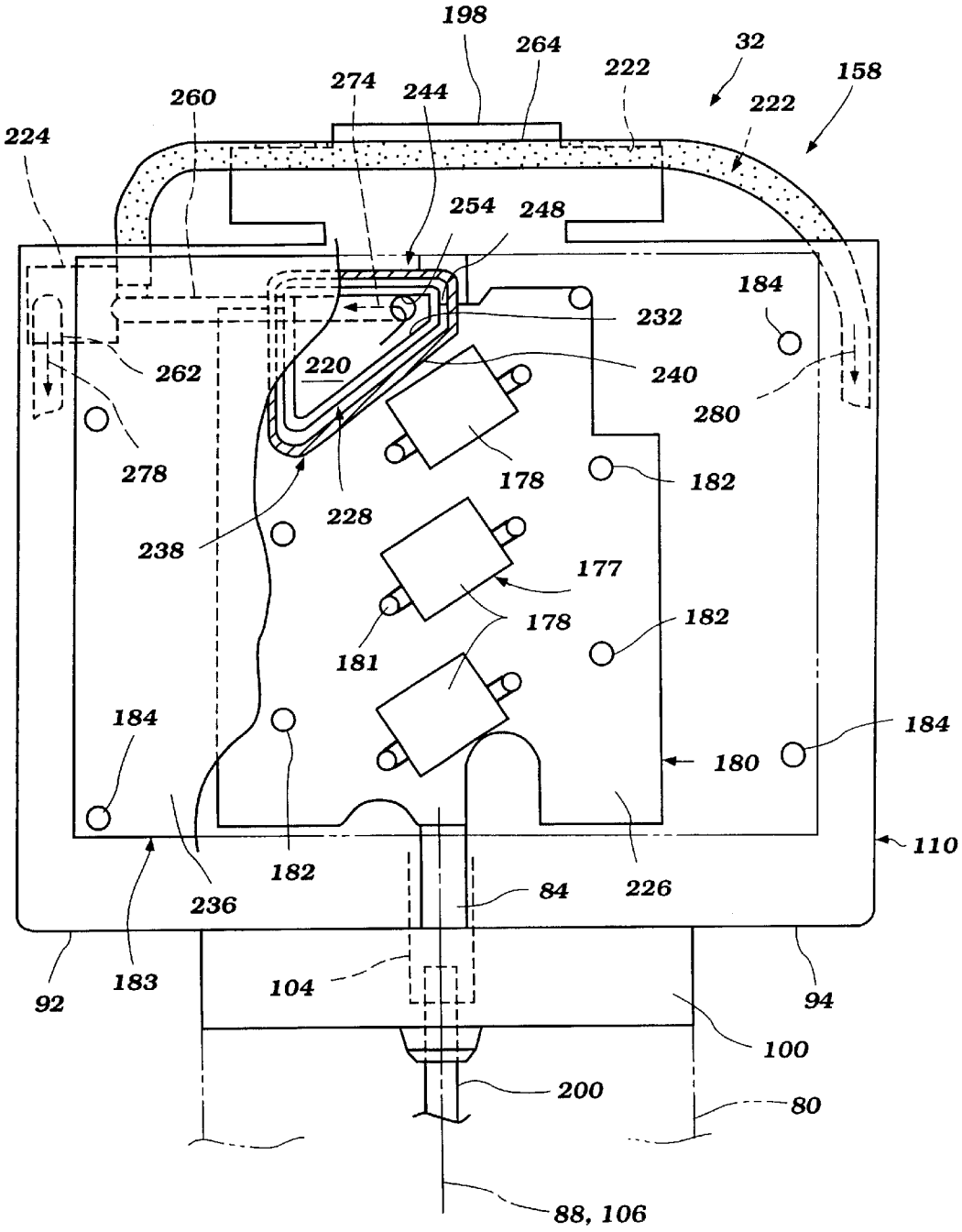
FIG. 4 is a rear elevation view of the engine and the exhaust guide member. The exhaust guide member is partially shown in phantom line.
Figure 5:
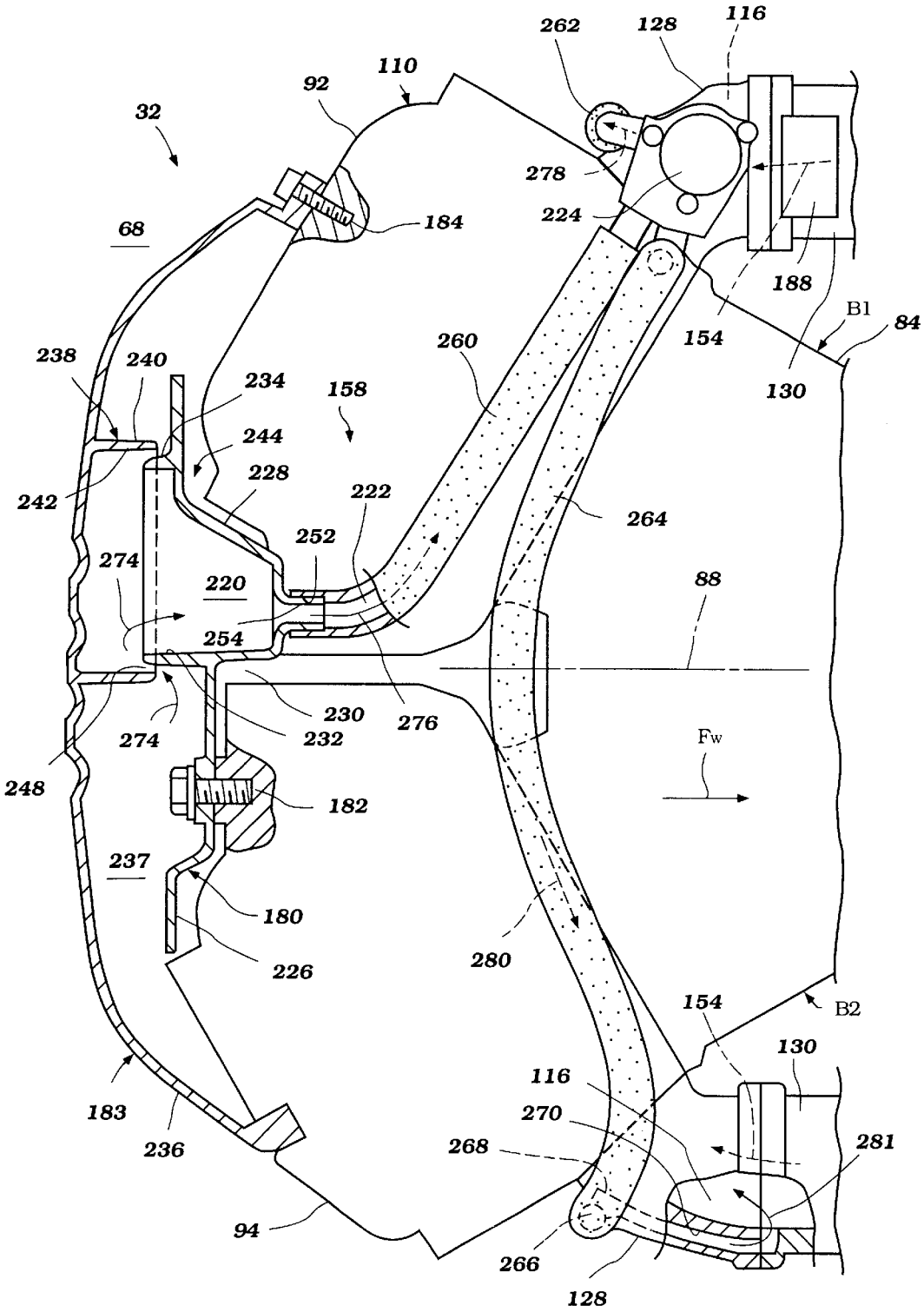
FIG. 5 is an enlarged, partially sectioned, top plan view of the engine. A bracket and a cover member are shown in section.

With primary reference to FIGS. 2, 4 and 5, the ISC mechanism 158 will now be described in greater detail. The ISC mechanism 158 preferably comprises an idle air or auxiliary plenum chamber 220, an idle air or auxiliary intake passage 222 and an ISC device 224. Preferably, the idle plenum chamber 220 is defined separately from the primary plenum chambers 118 and is generally disposed in a rear space of the cavity 68 opposite to the plenum chambers 220. In the illustrated embodiment, the bracket 180 and the cover member 183 together define the idle plenum chamber 220.

The bracket 180 preferably is made of plastic. As illustrated in FIG. 5, the plastic material is shaped, for example, in an injection molding process, to have a generally planar body portion 226 and a chamber portion 228. The ignition coils 180 are mounted on the body portion 226 that is affixed to the cylinder head assemblies 92, 94. The chamber portion 228 preferably is disposed in a recessed space 230 that is formed between the cylinder head assemblies 92, 94 as seen in FIG. 5. Advantageously, such a construction provides a compact construction that can reduce the overall size of the engine. In the illustrated arrangement, the recessed space 230 is positioned above the uppermost ignition coil 178 as seen in FIG. 4. The chamber portion 228 defines a recess 232, which is disposed within the recessed space 230, that is generally configured as a triangular shape in a rear view and opens toward the cover member 183 in the illustrated arrangement. Any other configuration, such as a circular shape, also can be used instead of the triangular shape. A rim or flange 234 extends toward the cover member 183 generally in parallel to the longitudinal center plane 88.

The cover member 183, which preferably is made of plastic also, is shaped, for example, in an injection process to have a cover portion 236 and a counter-chamber portion 238. Preferably, the cover portion 236 almost entirely covers not only the bracket 180 but also a large area of the cylinder head assemblies 92, 94. A sub-chamber 237 thus is formed therebetween that can act as an air coordinator and/or a silencer. Air within the cavity 68 can enter the sub-chamber 237 through gaps defined between the cover portion 236 and the cylinder head assemblies 92, 94.

The counter-chamber portion 238 in turn is disposed at a location corresponding to the location of the bracket 180 where the chamber portion 228 of the bracket 180 is positioned. The chamber portion 238 includes a rim or flange 240 extending toward the bracket 180 generally in parallel to the longitudinal center plane 88. A recess 242 also is formed therein as a triangular shape that is analogous to the triangular shape of the recess 232. Any other configurations such as a circular shape can of course be used instead of the triangular shape. Preferably, the shape of the recess 242 and the shape of the recess 232 are complementary.

In the illustrated embodiment, the rim 240 of the cover member 183 is slightly larger than the rim 234 of the bracket 180, and is slightly overlapped with the rim 234. It should be noted, however, the size of each rim 234, 240 is interchangeable. Air, thus, is drawn through a gap defined between the rim 240 and the corresponding rim 234.

As thus constructed and arranged, the idle plenum chamber 220 coordinates air therein and/or acts as a silencer. The idle plenum chamber 220 is defined with both of the recesses 232, 242. That is, an idle or auxiliary plenum chamber unit or voluminous unit 244 is formed with both the chamber portion 228 of the bracket 180 and the chamber portion 238 of the cover member 183. The idle plenum chamber 220 is disposed opposite to the bracket assembly 36 relative to the engine body 110, while the primary plenum chambers 118 are disposed between the bracket assembly 36 and the engine body 110. The bracket 180 and the cover member 183 can be made of sheet metal in some arrangements. In such arrangements, they can be shaped in a press process, for example.

Because the respective size of the rims 234, 240 are different from one another, a triangular opening or gap 248 is made between the rims 234, 240. The opening 248 can be an inlet port of the plenum chamber 220. The chamber portion 228 of the bracket 180 defines a projection 252 through which an aperture 254 is formed. The aperture 254 can be an outlet port of the plenum chamber 220.

A housing of the ISC device 224 preferably is disposed atop a portion of the upper-most intake conduit 128 of the cylinder bank B1 on the port side downstream of the throttle valve assembly 130 and can be affixed thereto by appropriate fasteners, such as bolts. The idle air intake passage 222 connects the control device 224 with the idle plenum chamber 220 and with the respective intake passages 116. The illustrated ISC device 224 is an ISC valve that preferably is formed with, for example, a needle valve or solenoid valve to measure or regulate an amount of idle air flowing therethrough under control of the ECU 172. A control line for the ISC valve is omitted in the figures. That is, the needle valve or solenoid valve can move between an open position and a closed position, which disables communication between the idle plenum chamber 220 and the intake passages 116.

The ECU 172 preferably opens the ISC valve 224 when the throttle valves 132 of the primary intake passages 116 are almost closed. Desirably, the opening degree of the ISC valve 224 can be changed to selectively maintain the foregoing trolling condition.

In some occasions, such as when the operator suddenly operates the throttle valves 132 to increase the air amount, i.e., to abruptly accelerate the engine speed, a huge amount of air, which is more than accommodated by the maximum airflow through the intake conduits 116, can be required. The ECU 172 preferably senses sudden acceleration if the signal of the intake pressure sensor 188 and/or the signal of the throttle position sensor 192 indicates that the air flow in the intake passages 116 increases and a change rate of at least one of the signals is greater than a preset ratio. The ECU 172, when sudden acceleration is sensed, can control the ISC valve 224 via the device 224 to allow additional air to flow to the engine 32. The ISC device or valve 224, in some occasions, can be omitted. The device, however, is advantageously provided for accurate control of the idle or trolling engine speeds and/or to better facilitate sudden acceleration.

The idle air intake passage 222 preferably comprises three flexible intake conduits 260, 262, 264 made of a flexible material such as, for example, rubber material. The first conduit 260 extends generally horizontally over at least a portion of the cylinder head assembly 92 to couple the idle plenum chamber unit 244 with the idle air control device 224. The second conduit 262 extends generally vertically aside the respective intake conduits 128 of the cylinder bank B1 on the port side and downstream of the throttle valve assemblies 130 to couple the ISC device 224 with the respective intake conduits 128 of the cylinder bank B1. The third conduit 264 extends generally horizontally over both of the cylinder head assemblies 92 or the cylinder block 84 to couple the ISC device 224 with the respective conduits 128 of the cylinder bank B2 on the starboard side.

The second and third conduits 262, 264 also can have branched off portions that define three outlet ports 266 (see FIG. 5), while the downstream portions of the respective intake conduits 128 have inlet ports 268. The respective outlet ports 266 of the conduits 266, 266 can be connected to the inlet ports 268 of the respective intake conduits 128. As illustrated in FIG. 5, the respective downstream portions of the intake conduits 128 have side passages 270 that connect the inlet ports 268 to the intake passages 116.

The air within the closed cavity 68 is drawn into the sub-chamber 237 defined by the cover portion 236 of the cover member 183. In this sub-chamber 237, the air is coordinated and/or the intake noise is reduced to the certain extent. The air then goes into the idle plenum chamber 220 through the triangular opening 248 as indicated by the arrows 274 of FIG. 5. The air is relatively completely coordinated in this plenum chamber 220. The intake noise also is substantially completely reduced in the chamber 220. The air flows into the first flexible conduit 260 through the aperture 254 as indicated by the arrow 276 of FIG. 5 and goes to the ISC valve 224. The ECU 172 controls the opening degree of the ISC valve 224 in response to the situations such that the throttle valves 132 are almost closed or the sudden acceleration is required. Only the regulated amount of the air thus can pass through the ISC valve 224. While one portion of the air goes to the downstream portions of the intake passages 116 of the cylinder bank B1 through the flexible conduit 262 as indicated by the arrow 278 of FIG. 5, the other portion of the air goes to the downstream portions of the intake passages 116 of the cylinder bank B2 through the flexible conduit 264 as indicated by the arrow 280 of FIG. 5. The air then separately flows into the respective side passages 270 of the intake conduits 128 to go to the respective combustion chambers 96 as indicated by the arrow 281 of FIG. 5.

As thus described, the illustrated ISC mechanism is connected to the primary intake passages downstream the throttle valve assemblies. Because of this arrangement, no negative pressure that can be produced by the light air flow through the primary intake passages can exert any influence upon the air supply through the ISC mechanism. The idle speed thus can be held in a proper range as initially set. The set idle speed in this embodiment is approximately 700 rpm. Also, under sudden acceleration, if a control is applied, an accurate amount of air can be added to the amount of the air that is supplied through the primary passages. Undesired acceleration speed thus can be avoided accordingly.

Also, the illustrated idle plenum chamber is disposed opposite to the bracket assembly. In other words, the idle plenum chamber is placed at the farthest location from the operator. In addition, the engine body lies between the idle plenum chamber and the operator. Any noise generated within the chamber, even if it occurs, can be isolated from the operator as much as possible accordingly.

The illustrated idle plenum chamber also is separated from the primary plenum chambers. Even if the vapor from the vapor separator is delivered to the intake system, the vapor will not enter the ISC mechanism in the illustrated arrangement. Thus, the air/fuel ratio in the idle speed operation of the engine is not influenced by the vapor because the vapor is not introduced into the ISC mechanism.

The illustrated idle plenum chamber is formed with the bracket and the cover member, which are provided for the ignition coils. Accordingly, no additional members are necessary. The construction thus is simple, neat and inexpensive in comparison with a construction in which particular members are employed.

In the illustrated arrangement, the cover member can form the sub-chamber around the idle plenum chamber. The sub-chamber can enhance the air coordinating effect and/or the silencing effect of the idle plenum chamber further. In addition, the major portion of the idle plenum chamber in the illustrated embodiment is positioned in the space defined between the cylinder head assemblies. The relatively narrow space thus is efficiently used. Further, the chamber portions of the bracket and the cover members including rims are useful for reinforcing the structures.

It should be noted that the idle plenum chamber can be formed with a combination of another bracket and cover member that are provided for electric components or engine components other than the ignition coils. Any other bracket members and/or cover members can replace the bracket and the cover member, respectively. Also, the plenum chamber can be formed with a member other than a cover member. Moreover, the plenum chamber can be formed with a single piece. In some applications, the ISC valve 224 can be disposed within the subchamber 237 or idle plenum chamber 220 such that the conduit 260 can be removed.

Figure 6:
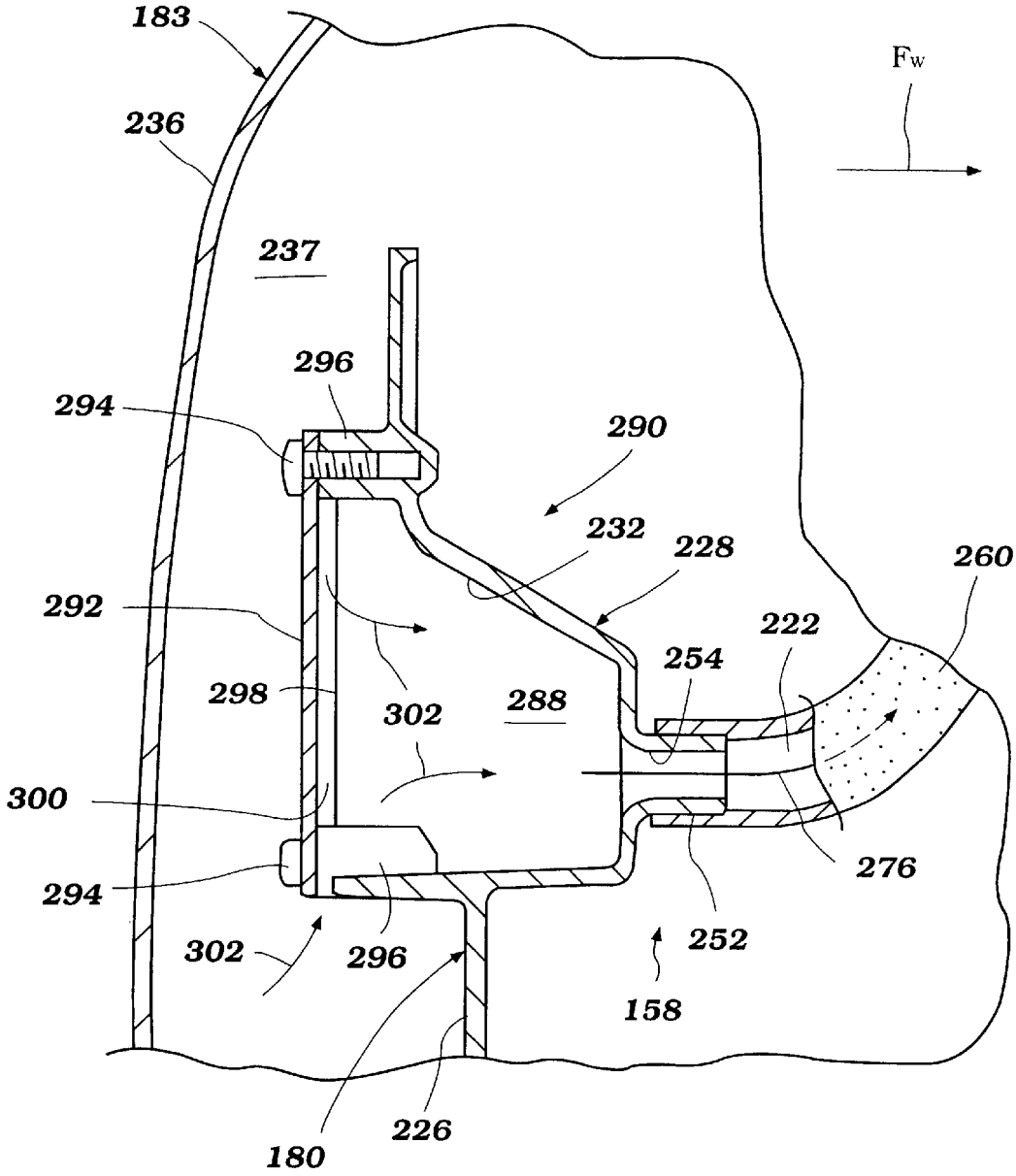
FIG. 6 is an enlarged, partially sectioned, top plan view of an engine configured in accordance with another embodiment of the present invention. A bracket and a cover member are shown in section in this figure. In order to simplify the drawing, the cylinder head assemblies associated with the engine are omitted in this figure.
Figure 7:
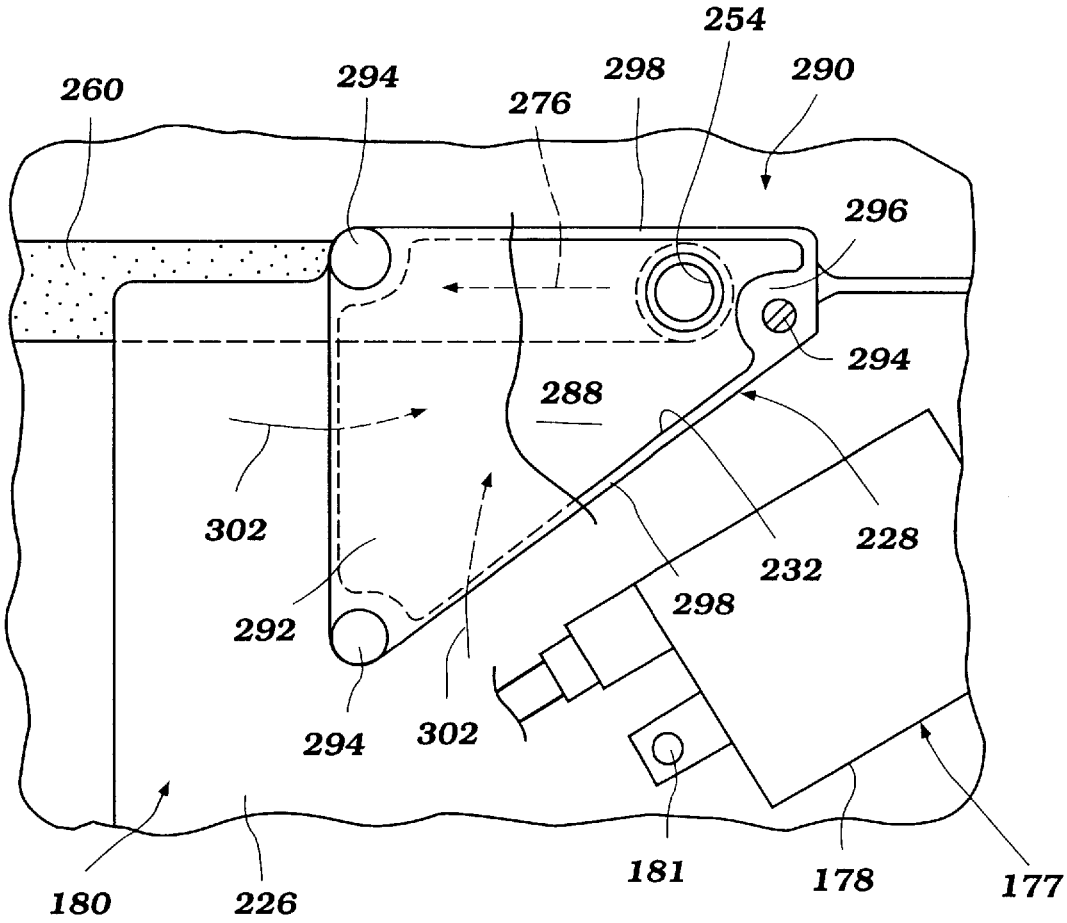
FIG. 7 is an enlarged partial rear view of the engine.

FIGS. 6 and 7 illustrate another exemplary construction and arrangement of the idle plenum chamber. The same members and components as those which are already described will be assigned with the same reference numerals and will not be described repeatedly.

An idle plenum chamber 288, i.e., an idle plenum chamber unit 290, in this construction is formed with the bracket 180 and a plate 292 which acts as a lid for the recess 232 of the chamber portion 228. The plate 292 preferably is configured generally as a triangular shape that is generally consistent with the triangular shape of the chamber portion 228 and is affixed to the chamber portion 228 by appropriate fasteners such as bolts 294. Preferably, three bolts 294 are used so that each corner of the triangular configuration has the bolt 294. Boss portions 296 where the bolts 294 are positioned protrude more rearwardly than other portions. In other words, the rear edges 298 extending between the boss portions 296 are positioned slightly forwardly of the rear ends of the boss portions 296. Thus, slots 300 are formed between the respective boss portions 296. Air can enter the idle plenum chamber 288 through the slots 300 as indicated by the arrow 302 of FIGS. 6 and 7. The air goes to the idle intake passage 222 through the opening 254 as indicated by the arrow 276 of FIGS. 6 and 7.

Figure 8:
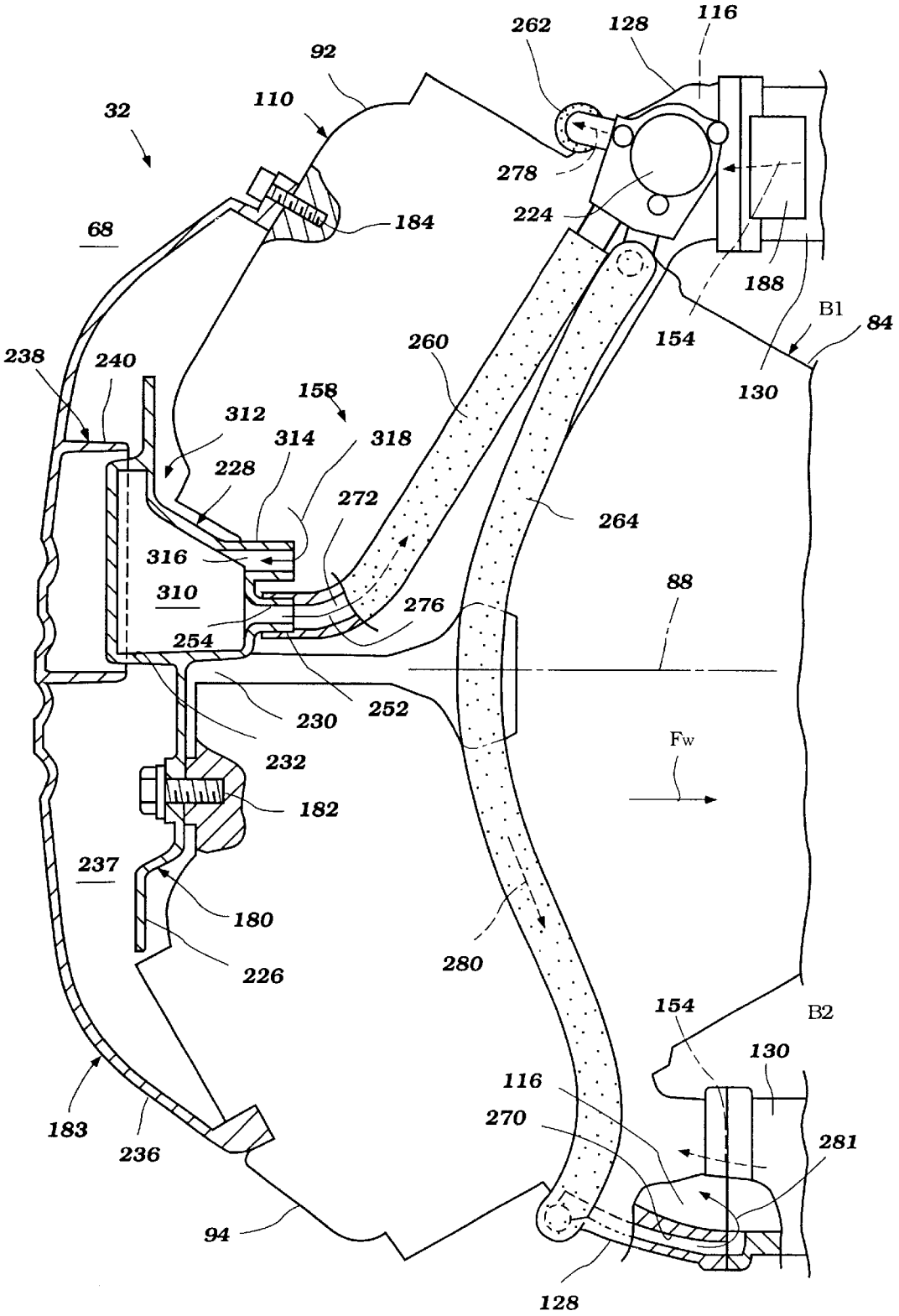
FIG. 8 is an enlarged, partially sectioned, top plan view of an engine configured in accordance with a further embodiment of the present invention. A bracket and a cover member are shown in section.
Figure 9:
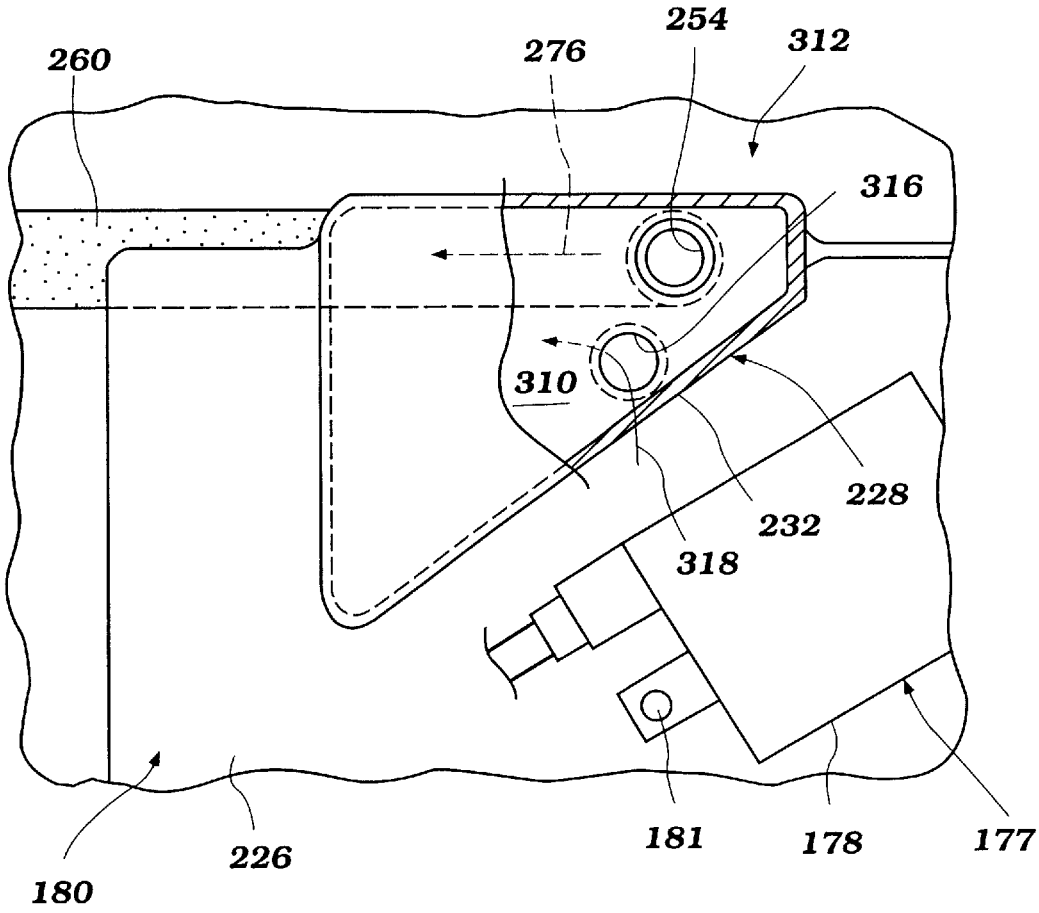
FIG. 9 is an enlarged partial rear view of the engine.

FIGS. 8 and 9 illustrate a further exemplary construction and arrangement of the idle plenum chamber. Again, the same members and components as those which are already described will be assigned with the same reference numerals and will not be described repeatedly.

An idle plenum chamber 310, i.e., an idle plenum chamber unit 312, in this construction is formed solely with the bracket 180. The plenum chamber unit 312 has a projection 314 extending generally forwardly in parallel to the projection 252. The projection 314 defines an inlet port 316 of the plenum chamber 310. Air can enter the idle plenum chamber 310 through the inlet port 316 as indicated by the arrow 318 of FIGS. 8 and 9. The air goes to the idle intake passage 222 through the opening 254 as indicated by the arrow 276 of FIGS. 8 and 9. The chamber portion 238, i.e., the rim 240, of the cover member 183 can be omitted in this arrangement.

Of course, the foregoing description is that of a preferred construction having certain features, aspects and advantages in accordance with the present invention. Various changes and modifications may be made to the above-described arrangements without departing from the spirit and scope of the invention, as defined by the appended claims. For instance, the inlets to the idle plenum chambers of the various configurations can be mixed together such that more than one inlet variation is used in a single construction. Accordingly, the scope of the present invention should not be limited to the illustrated configurations, but should only be limited to a fair construction of the claims that follow and any equivalents of the claims.

What is claimed is:

1. An internal combustion engine comprising an engine body and an air induction system, the engine body comprising a cylinder block defining a cylinder bore, a piston reciprocally mounted in the cylinder bore, and a cylinder head assembly closing an end of the cylinder bore to define a combustion chamber together with the cylinder bore and the piston, the air induction system arranged to introduce air into the combustion chamber, the induction system including a first intake conduit through which the air flows to the combustion chamber, a first plenum chamber unit being disposed upstream of the first intake conduit and communicating with the first intake conduit, a control mechanism arranged to control an amount of the air flowing through the first intake conduit, a second intake conduit through which the air flows to the combustion chamber, and a second plenum chamber unit being disposed upstream of the second intake conduit and communicating with the second intake conduit, the second intake conduit being coupled with the first intake conduit downstream of the control mechanism and the second plenum chamber unit having an air supply separate from the first intake conduit.

2. The engine as set forth in claim 1, wherein the second plenum chamber unit includes a first member and a second member which define a chamber.

3. The engine as set forth in claim 2, wherein the first member defines a first recess, the second member defines a second recess, the first and second members meet together so that the first and second recesses form the chamber with each other.

4. The engine as set forth in claim 3, wherein one of the first and second members defines a port communicating with the second intake conduit.

5. The engine as set forth in claim 3, wherein the first member has a first rim portion defining the first recess, the second member has a second rim portion defining the second recess, one of the first and second rim portions is formed larger than the other one of the first and second rim portions, and the larger rim portion encases the other rim portion at least in part.

6. The engine as set forth in claim 5, wherein the first and second rim portions together define an opening therebetween through which the air is introduced into the plenum chamber.

7. The engine as set forth in claim 2, wherein at least one of the first and second members is affixed to the engine body.

8. The engine as set forth in claim 7, wherein at least one of the first and second members is affixed to the cylinder head assembly.

9. The engine as set forth in claim 7, wherein the other one of the first and second members is affixed to the engine body at a location other than a location where the first member is affixed.

10. The engine as set forth in claim 7 additionally comprising an engine component relating to an operation of the engine, wherein one of the first and second members defines a mount portion at which the engine component is mounted.

11. The engine as set forth in claim 10, wherein the other one of the first and second members defines a cover portion to cover the engine component.

12. The engine as set forth in claim 10 additionally comprising an ignition system arranged to ignite the combustion chamber, wherein the engine component includes a component relating to the ignition system.

13. The engine as set forth in claim 2, wherein the first and second members together define an opening therebetween through which the air is introduced into the chamber.

14. The engine as set forth in claim 2, wherein the first member defines a recess, the second member defines a lid generally covering the recess, and the recess and the lid together form the chamber.

15. The engine as set forth in claim 14, wherein the first and second members together define an opening therebetween through which the air is introduced into the chamber.

16. The engine as set forth in claim 14, wherein the first member defines a port communicating with the second intake conduit.

17. The engine as set forth in claim 14, wherein the first member is affixed to the engine body.

18. The engine as set forth in claim 14, wherein the second member is affixed to the first member.

19. The engine as set forth in claim 1 additionally comprising a space forming member affixed to the engine body to form a space together with the engine body, wherein the second plenum chamber unit is disposed within the space.

20. The engine as set forth in claim 19, wherein the second plenum chamber unit defines an opening communicating with the space.

21. The engine as set forth in claim 19, wherein the second plenum chamber unit is affixed to the engine body.

22. The engine as set forth in claim 21, wherein both the space forming member and the second plenum chamber unit are affixed to the cylinder head member.

23. The engine as set forth in claim 1, wherein the cylinder block defines at least two cylinder bores forming a V configuration with one another, two of the cylinder head assemblies close the respective cylinder bores, and the second plenum chamber unit, at least in part, is disposed between the cylinder head assemblies.

24. The engine as set forth in claim 1 additionally comprising a fuel injection system arranged to spray fuel for combustion toward the combustion chamber, the fuel injection system including a vapor separator and a vapor delivery conduit coupling the vapor separator with the first plenum chamber unit.

25. The engine as set forth in claim 1, wherein the first plenum chamber unit includes a silencer.

26. The engine as set forth in claim 1, wherein the second plenum chamber unit includes a silencer.

27. An internal combustion engine for powering a marine propulsion device comprising an engine body and an air induction system, the engine body comprising a cylinder block defining a cylinder bore, a piston reciprocally mounted in the cylinder bore, and a cylinder head assembly closing an end of the cylinder bore to define a combustion chamber together with the cylinder bore and the piston, the air induction system arranged to introduce air into the combustion chamber, the induction system including a first intake conduit through which the air flows to the combustion chamber, a first plenum chamber unit being disposed upstream of the first intake conduit, a control mechanism arranged to control an amount of the air flowing through the first intake conduit, a second intake conduit through which the air flows to the combustion chamber, and a second plenum chamber unit being disposed upstream of the second intake conduit, the second intake conduit being coupled with the first intake conduit downstream of the control mechanism.

28. The engine as set forth in claim 27, wherein the air flows through the second intake conduit to the combustion chamber when the control mechanism generally inhibits the air from flowing through the first intake conduit to the combustion chamber.

29. The engine as set forth in claim 27 additionally comprising a second control mechanism arranged to control an amount of the air flowing through the second intake conduit.

30. The engine as set forth in claim 29, wherein the second control mechanism allows the air to flow through the second intake conduit to the combustion chamber when further air is necessary in addition to the air flowing through the first intake conduit to the combustion chamber.

31. The engine as set forth in claim 27, wherein the first and second plenum chamber units are disposed opposite to each other relative to the engine body.

32. The engine as set forth in claim 27, wherein the cylinder block defines a plurality of cylinder bores extending generally horizontally and spaced apart vertically from each other, and the second intake conduit at least in part extends above the engine body.

33. The engine as set forth in claim 27, wherein the engine operates on a four-cycle combustion principle.

34. An internal combustion engine comprising an engine body, a moveable member moveable relative to the engine body, movement of the moveable member being transferred to a marine propulsion device, the engine body and the moveable member together at least partially defining a combustion chamber, an air induction system arranged to introduce air into the combustion chamber, the induction system including a primary intake conduit through which the air flows to the combustion chamber, a first voluminous unit disposed upstream of and communicating with the primary intake conduit, a throttle valve arranged to control an amount of the air flowing through the primary intake conduit, the throttle valve generally allowing the majority of the air to flow through the primary intake conduit at an engine speed above an idle speed, an auxiliary intake conduit through which air at the idle speed flows to the combustion chamber, and a second voluminous unit disposed upstream of the auxiliary intake conduit, the auxiliary intake conduit communicating with the primary intake conduit downstream of the throttle valve.

35. The engine as set forth in claim 34, wherein the second voluminous unit includes a first member and a second member that together at least partially define a voluminous chamber therein.

36. The engine as set forth in claim 35, wherein the first member defines a first recess, the second member defines a second recess, the first and second members meet together so that the first and second recesses form the voluminous chamber with each other.

37. The engine as set forth in claim 35, wherein at least one of the first and second members is affixed to the engine body.

38. The engine as set forth in claim 35, wherein the first and second members together define an opening therebetween through which the air is introduced into the voluminous chamber.

39. The engine as set forth in claim 35, wherein the first member defines a recess, the second member defines a lid generally covering the recess, and the recess and the lid together form the voluminous chamber.

40. The engine as set forth in claim 34 additionally comprising a space forming member affixed to the engine body to form a space together with the engine body, wherein the second voluminous unit is disposed within the space.

41. The engine as set forth in claim 34 additionally comprising a control valve arranged to control an amount of the air flowing through the auxiliary intake conduit, the control valve allowing air to flow through the auxiliary intake conduit at the idle engine speed.

42. The engine as set forth in claim 34 additionally comprising a control valve arranged to control an amount of the air flowing through the auxiliary intake conduit, a sensor to sense a condition of the air flow within the primary intake conduit, and a control device configured to control the control valve based upon a signal of the sensor, wherein the control valve allows air to flow through the auxiliary intake conduit when the signal indicates that the air flow in the primary intake conduit has increased and a change ratio of the signal is greater than a preset ratio.

43. The engine as set forth in claim 34 additionally comprising a fuel injection system arranged to spray fuel for combustion in the combustion chamber, the fuel injection system including a vapor separator that is in communication with the first voluminous chamber.

44. An internal combustion engine comprising an engine body, a moveable member moveable relative to the engine body, the engine body and the moveable member together defining a combustion chamber, an air induction system arranged to introduce air into the combustion chamber, the induction system including an intake conduit through which the air flows, a first member, and a second member together with the first member defining a plenum chamber disposed upstream the intake conduit, both the first and second members being mounted on the engine body, and the first and second members being coupled with one another to form a gap therebetween through which the air enters the plenum chamber.

45. The internal combustion engine as set forth in claim 44, wherein one of the first and second members is a bracket on which an engine component is mounted.

46. The internal combustion engine as set forth in claim 45, wherein the other one of the first and second members is a cover member arranged to cover the engine component.

47. An outboard motor comprising a drive unit, and a bracket assembly adapted to be mounted on an associated watercraft to support the drive unit, the drive unit including an internal combustion engine, the engine comprising an engine body, a moveable member moveable relative to the engine body, the engine body and the moveable member together defining a combustion chamber, an air induction system arranged to introduce air into the combustion chamber, the induction system including a first intake conduit through which the air flows to the combustion chamber, a first plenum chamber unit disposed upstream of the first intake conduit, a control mechanism configured to control an amount of the air flowing through the first intake conduit, a second intake conduit through which the air flows to the combustion chamber, and a second plenum chamber unit disposed upstream of the second intake conduit, the second intake conduit being coupled with the first intake conduit downstream of the control mechanism, and the second plenum chamber unit being disposed opposite to the bracket assembly relative to the engine body.

48. The outboard motor as set forth in claim 47, wherein the first plenum chamber unit is disposed between the bracket assembly and the engine body.

49. The outboard motor as set forth in claim 47, wherein the engine additionally comprises a fuel injection system arranged to spray fuel for combustion in the combustion chamber, the fuel injection system includes a vapor separator, and a vapor delivery conduit couples the vapor separator with the first plenum chamber unit.

50. The outboard motor as set forth in claim 47, wherein the second plenum chamber is only connected to a portion of the first intake conduit located downstream of the control mechanism through the second intake conduit.

51. An internal combustion engine comprising an engine body, a moveable member moveable relative to the engine body, the engine body and the moveable member together at least partially defining a combustion chamber, an air induction system arranged to introduce air into the combustion chamber, the induction system including a primary intake conduit through which the air flows to the combustion chamber, a first voluminous unit disposed upstream of the primary intake conduit, a throttle valve arranged to control an amount of the air flowing through the primary intake conduit, the throttle valve generally allowing the majority of the air to flow through the primary intake conduit at an engine speed above an idle speed, an auxiliary intake conduit through which air at the idle speed flows to the combustion chamber, and a second voluminous unit disposed upstream of the auxiliary intake conduit, the second voluminous unit being only connected to a portion of the primary intake conduit located downstream of the throttle valve through the auxiliary intake conduit.

* * * * *